US008343313B2

(12) United States Patent
Mimura et al.

(10) Patent No.: US 8,343,313 B2
(45) Date of Patent: Jan. 1, 2013

(54) PLANT FOR PRODUCTION OF PAPER-MADE PART FOR SPEAKER, PAPER-MADE PART FOR SPEAKER PRODUCED THEREBY, AND SPEAKER UTILIZING THE SAME

(75) Inventors: Kazuyoshi Mimura, Mie (JP); Kenichi Ajiki, Mie (JP); Shinya Mizone, Mie (JP); Masahide Sumiyama, Mie (JP); Toru Fujii, Shiga (JP)

(73) Assignee: Panasonic Corporation, Osaka (JP)

( * ) Notice: Subject to any disclaimer, the term of this patent is extended or adjusted under 35 U.S.C. 154(b) by 1157 days.

(21) Appl. No.: 12/162,541

(22) PCT Filed: Feb. 23, 2007

(86) PCT No.: PCT/JP2007/053351

§ 371 (c)(1),
(2), (4) Date: Jul. 29, 2008

(87) PCT Pub. No.: WO2007/105454

PCT Pub. Date: Sep. 20, 2007

(65) Prior Publication Data

US 2009/0028373 A1 Jan. 29, 2009

(30) Foreign Application Priority Data

Mar. 1, 2006 (JP) ..... 2006-054540
Mar. 29, 2006 (JP) ..... 2006-091190

(51) Int. Cl.
*D21B 1/30* (2006.01)
*D21B 1/36* (2006.01)

(52) U.S. Cl. ..... 162/247; 162/21; 162/261; 162/288; 162/382; 241/40

(58) Field of Classification Search ..... 162/9, 21, 162/94, 148, 204, 223, 261, 267, 288, 382, 162/387; 241/5, 28, 40; 161/247
See application file for complete search history.

(56) References Cited

U.S. PATENT DOCUMENTS 4,374,702 A 2/1983 Turbak et al.

(Continued)

FOREIGN PATENT DOCUMENTS

CN 1207011 A 2/1999

(Continued)

OTHER PUBLICATIONS

Machine Translation of Japanese Patent Publication JP 2526561, 1996, Advanced Industrial Property Network, Japan Patent Office, [online], [retrieved on May 11, 2012]. Retrieved from the Internet: <URL: http://dossier1.ipdl.inpit.go.jp/AIPN/odse_top_dn.idpl?N0000=7400 >.*

(Continued)

*Primary Examiner* — Matthew Daniels
*Assistant Examiner* — Dennis Cordray
(74) *Attorney, Agent, or Firm* — RatnerPrestia

(57) ABSTRACT

The production equipment of paper-made components for loudspeakers includes a mixing device, a fining device, a paper-making device, and a shape processing device. The mixing device mixes material of a paper-made component for a loudspeaker into liquid to generate mixed liquid. The fining device includes a pressure unit, an orifice, and an inner wall. The pressure unit applies pressure on the mixed liquid to cause the mixed liquid to pass through the orifice, and the mixed liquid collides against the inner wall to cause the fining device to generate fined material. The paper-making device paper-makes the fined material to generate a paper-made component. The shape processing device processes the shape of the paper-made component. This structure provides production equipment of the paper-made components for loudspeakers, which prepares material for paper-making in a short time and reduces producing time.

8 Claims, 10 Drawing Sheets

U.S. PATENT DOCUMENTS

| | | | | |
|---|---|---|---|---|
| 5,274,199 | A | 12/1993 | Uryu et al. | |
| 6,059,926 | A | 5/2000 | Hiroshima | |
| 2006/0059884 | A1 * | 3/2006 | Zhou et al. | 57/252 |

FOREIGN PATENT DOCUMENTS

| | | | | |
|---|---|---|---|---|
| JP | 57-196694 | | | 12/1982 |
| JP | 60-19921 | B2 | | 5/1985 |
| JP | 61-019893 | A | | 1/1986 |
| JP | 61-019894 | A | | 1/1986 |
| JP | 63-126985 | A | * | 5/1988 |
| JP | 63-126985 | A | | 5/1988 |
| JP | 63-135515 | A | | 6/1988 |
| JP | 63-196790 | | | 8/1988 |
| JP | 03-120999 | A | | 5/1991 |
| JP | 4-23597 | A | | 1/1992 |
| JP | 04281697 | A | * | 10/1992 |
| JP | 04-367198 | A | | 12/1992 |
| JP | 5-211696 | | | 8/1993 |
| JP | 05-211696 | A | | 8/1993 |
| JP | 06-062494 | A | | 3/1994 |
| JP | 06-311595 | A | | 11/1994 |
| JP | 63-126985 | A | | 11/1994 |
| JP | 07-310296 | A | | 11/1995 |
| JP | 10-195788 | A | | 7/1998 |
| JP | 11-075289 | A | | 3/1999 |
| JP | 11-323800 | A | | 11/1999 |
| JP | 2000-017592 | A | | 1/2000 |
| JP | 2000-080521 | A | | 3/2000 |
| JP | 2003-129392 | A | | 5/2003 |
| JP | 2004-080465 | A | | 3/2004 |
| JP | 2006-054540 | | | 2/2011 |

OTHER PUBLICATIONS

DERWENT Abstract of JP 63-126985, 1996.*
JP Office Action for 2006-091190, Feb. 8, 2011.
JP Office Action for 2006-054540, Feb. 8, 2008.
Japanese Office Action for JP 2006-091190, Apr. 20, 2010.
International Search Report for International Application No. PCT/JP2007/053351 dated Jun. 5, 2007.

* cited by examiner

PLANT FOR PRODUCTION OF PAPER-MADE PART FOR SPEAKER, PAPER-MADE PART FOR SPEAKER PRODUCED THEREBY, AND SPEAKER UTILIZING THE SAME

This application is a U.S. National Phase Application of PCT International Application PCT/JP2007/053351, filed Feb. 23, 2007, which claims the benefit of Japanese Application Nos. 2006-054540, filed Mar. 1, 2006 and 2006-091190, filed Mar. 29, 2006.

TECHNICAL FIELD

The present invention relates to production equipment of paper-made components for loudspeakers using for various audio equipments, to a paper component produced with the production equipment, and to a loudspeaker including the component.

BACKGROUND ART

Recently, electronic appliances such as audio and video equipment have been improved dramatically in their performance as compared to conventional ones owing to the significant progress of digital technologies. With the performance improvement of electronic appliances, the market strongly solicits performance improvement of loudspeakers used for the appliances.

A diaphragm constitutes a great part of determining the sound quality of a loudspeaker among its component parts. For a loudspeaker the performance improvement of which is strongly solicited by the market, it is essential to improve the performance of the diaphragm and other vibrating parts.

As part of improving the performance of a diaphragm and other vibrating parts, it is extremely important to make sound and characteristics satisfying user needs by a field or application.

What implements making sound and characteristics satisfying the user needs is a paper-made component that has an advantage of fine-tuning the characteristics as a loudspeaker or sound quality, and thus developing paper-made components is receiving attention.

A description is made for conventional production equipment of paper-made components such as diaphragms, using FIGS. 14A through 14D, which are conceptual diagrams showing conventional production equipment of paper-made diaphragms for loudspeakers.

As shown in FIG. 14A, beating device 221 includes beater 201 and rotary blade 202. Material 210 of a paper-made diaphragm for a loudspeaker is inserted into beater 201 containing water, and rotary blade 202 is rotated. With this action, material 210 is beaten into fine pieces with beating device 221 spending several days.

Next, as shown in FIG. 14B, paper-making device 222 includes container 203 and mold 204. Mold 204 has wire mesh 205 arranged thereon. Material 210*a* beaten is skimmed onto mold 204 with paper-making device 222. This action discharges only moisture from material 210*a*. Further, material 210*a* is accumulated on mold 204 to form the shape of paper-made diaphragm 211 for a loudspeaker.

Next, as shown in FIG. 14C, pressure device 223 heat-pressurizes paper-made diaphragm 211 for a loudspeaker. Paper-made diaphragm 211 for a loudspeaker is heat-pressurized by pressure device 223, further removing moisture remaining in paper-made diaphragm 211 for a loudspeaker by vaporization.

Next, as shown in FIG. 14D, punching device 224 has stamping die 206. Paper-made diaphragm 211 for a loudspeaker with its moisture vaporized is stamped by stamping die 206 into an outermost periphery and a center hole through which a voice coil is inserted, using punching device 224. This action produces paper-made diaphragm 211*a* for a loudspeaker.

Here, the description is made for production equipment of press diaphragms. Meanwhile, production equipment of oven diaphragms exists, where paper-made diaphragm 211 for a loudspeaker is produced by being dried for approximately one day or two, without using pressure device 223 for press working. An oven diaphragm is called a non-press diaphragm as well.

Such conventional production equipment of paper-made components for loudspeakers is disclosed in Japanese Patent Unexamined Publication No. 2004-80465 (patent literature 1), for example. Further, a method of manufacturing an aqueous suspension of rigid straight chain synthesis polymer molecule fiber, using a pressure type homogenizer is disclosed in Japanese Patent Unexamined Publication No. S63-196790 (patent literature 2), for example.

[Patent literature 1] Japanese Patent Unexamined Publication No. 2004-80465

[Patent literature 2] Japanese Patent Unexamined Publication No. S63-196790

SUMMARY OF THE INVENTION

The present invention provides a production equipment of a paper-made component for a loudspeaker with reduced producing time.

The production equipment of the paper-made component for the loudspeaker, of the present invention includes a mixing device, a fining device, a paper-making device, and a shape processing device. The mixing device mixes material of the paper-made component for the loudspeaker into a liquid to produce a mixed liquid. The fining device includes a pressure unit, an orifice, and an inner wall, where the pressure unit pressurizes the mixed liquid to cause the mixed liquid to pass through the orifice, and where the mixed liquid collides against the inner wall to generate fined material. The paper-making device makes a paper from the fined material to produce the paper-made component. The shape processing device processes a shape of a paper-made component. This structure provides the production equipment of the paper-made component for the loudspeakers that prepares material for paper-making in a short time and thus reduces producing time. Further, the paper-made component for the loudspeaker is produced using this production equipment and the loudspeaker including the paper-made component has an excellent loudspeaker characteristic and high productivity.

REFERENCE MARKS IN THE DRAWINGS

Figure 1A:
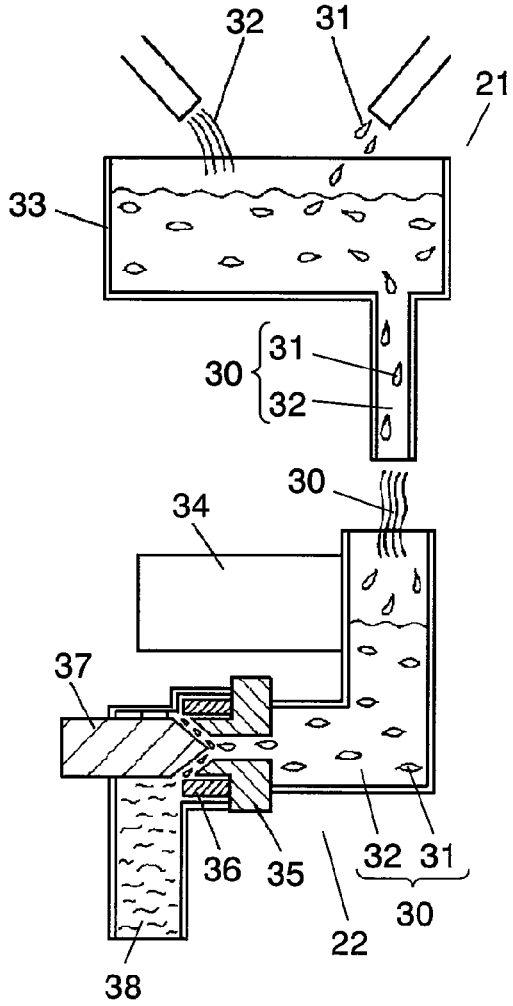
FIG. 1A is a conceptual diagram showing a part of a production equipment of a paper-made diaphragm for a loudspeaker, according to a first exemplary embodiment of the present invention.

21 Mixing device
22 Fining device
23 Paper-making device
24 Pressure device
25 Shape processing device
26 Blasting device
27 Beating device
31 Material
32 Liquid
33 Mixing bath
34 High-pressure pump
35 Orifice
36 Inner wall
37 Valve
38 Fined material
39 Container
40 Mold
41 Wire mesh
42, 42*a* Diaphragm material for a loudspeaker
43 Paper-made diaphragm for a loudspeaker
45 Stamping die
51 Autoclave
52 Lid
53 Pressure duct
54 Discharge duct
55 Safety valve
56 Open valve
57 Thermometer
58 Manometer
59 Material
61 Beater
62 Rotary blade
72 Sub-cone for a loudspeaker
73 Dust cap for a loudspeaker
80 Loudspeaker
81 Magnet
82 Upper plate
83 Yoke
84 Magnetic circuit
85 Magnetic gap
86 Frame
88 Voice coil
89 Edge

DETAILED DESCRIPTION OF PREFERRED EMBODIMENTS

Hereinafter, a description is made for the embodiments of the present invention using the related drawings.

First Exemplary Embodiment

Hereinafter, a description is made for the first exemplary embodiment of the present invention using the related drawings. Here, as a paper-made component for a loudspeaker, a paper-made diaphragm for the loudspeaker is taken as an example. However, the paper-made component for the loudspeaker is not limited to the paper-made diaphragm, but the present invention is applicable to such as a sub-cone and a dust cap for the loudspeaker.

Figure 2:
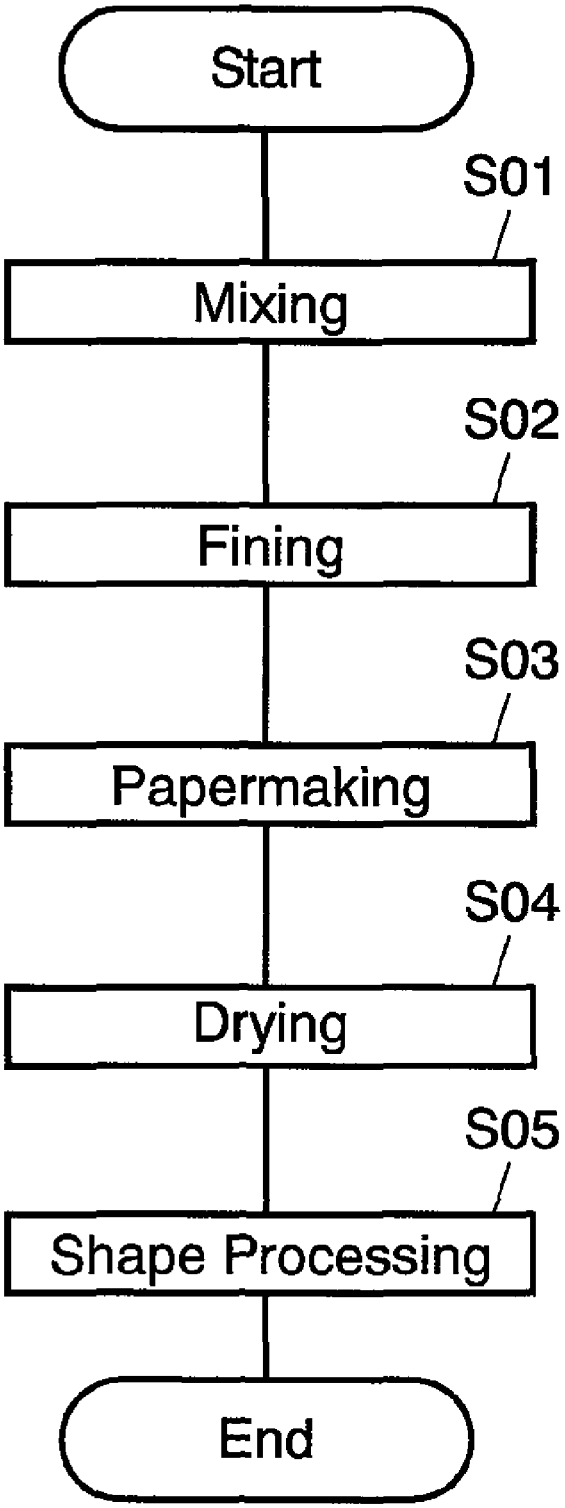
FIG. 2 is a flowchart illustrating a method of producing the paper-made diaphragm for the loudspeaker, according to the first embodiment of the present invention.
Figure 3:
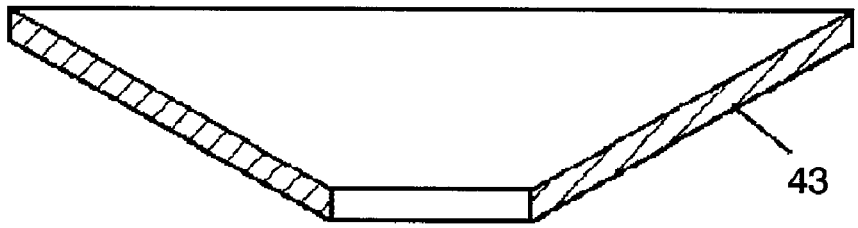
FIG. 3 is a sectional view of a paper-made diaphragm for a loudspeaker, according to the first embodiment of the present invention.

FIGS. 1A through 1D are conceptual diagrams showing a production equipment of the paper-made diaphragm for the loudspeaker, according to the first exemplary embodiment of the present invention. FIG. 2 is a flowchart illustrating a method of producing the paper-made diaphragm for the loudspeaker, using the production equipment in FIGS. 1A through 1D. FIG. 3 is a sectional view of the paper-made diaphragm for the loudspeaker, according to the first embodiment of the present invention.

As shown in FIG. 1A, mixing device 21 includes mixing bath 33. Fining device 22 includes high-pressure pump 34 as a pressure unit, orifice 35, and inner wall 36 as the wall of fining device 22.

First, in the mixing step, material 31 of paper-made diaphragm 43 (referred to as diaphragm 43 hereinafter) for a loudspeaker is inserted into mixing bath 33, and material 31 and liquid 32 are mixed together into mixed liquid 30 (S01). Here, material 31 may be in a state split into a fibrous form.

Next, pressure is applied on mixed liquid 30 by high-pressure pump 34. Mixed liquid 30 pressurized passes through orifice 35 provided facing valve 37. Mixed liquid 30 having passed through orifice 35 collides against inner wall 36 at high speed, and then is subjected to a shearing force by being decelerated after the collision. This action fines material 31 into fined material 38. The process is a fining step (S02) in which mixed liquid 30 is pressurized to pass through orifice 35, and collides against inner wall 36 so that material 31 is fined into fined material 38. Fined material 38 obtained in the fining step is in a microfibril state. Fining device 22 may be a high-pressure homogenizer.

The fining step with fining device 22 used is not limited to once, but may be repeated twice, three times, or n times (n: a positive integer) to obtain fined material 38 in a desired fined state or to execute the fining step plural times. When the fining step is executed plural times, either the same or plural fining devices 22 may used. When plural fining devices 22 are used, continuously arranging devices 22 enables the steps from inserting material into mixing device 21 to obtaining fined material 38 to be executed seamlessly.

If necessary, the fining step may be repeated tens of times. Even so, the time required for all the fining steps is short because one fining step completes in a short time. Here, if one fining step takes approximately 5 to 15 minutes, spending about one hour for plural fining steps results in 4 to 12 times of fining steps repeated.

Figure 1B:
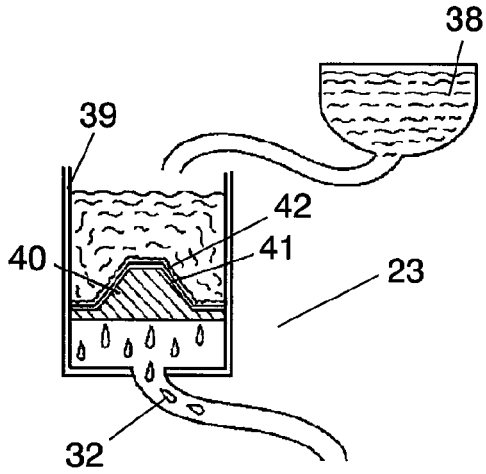
FIG. 1B is a conceptual diagram showing a part of the production equipment of the paper-made diaphragm for the loudspeaker, according to the first embodiment of the present invention.

Next, as shown in FIG. 1B, paper-making device 23 includes container 39 and mold 40. Mold 40 has wire mesh 41 arranged thereon. Fined material 38 having been fined in the fining step is inserted into container 39 to be skimmed onto mold 40 (paper-making step in S03). This action discharges moisture from fined material 38, where the moisture refers to liquid 32. Further, fined material 38 is accumulated on mold 40, thereby forming a shape of diaphragm material 42 for the loudspeaker.

Figure 1C:
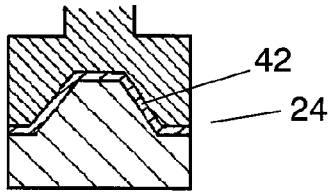
FIG. 1C is a conceptual diagram showing a part of the production equipment of the paper-made diaphragm for the loudspeaker, according to the first embodiment of the present invention.

Next, as shown in FIG. 1C, pressure device 24 heat-pressurizes diaphragm material 42 for the loudspeaker. Diaphragm material 42 is heat-pressurized by pressure device 24, further removing moisture (i.e. liquid 32) remaining in diaphragm material 42 by vaporization (drying step in S04). This action yields dry material 42*a* of the paper-made diaphragm for the loudspeaker.

Figure 1D:
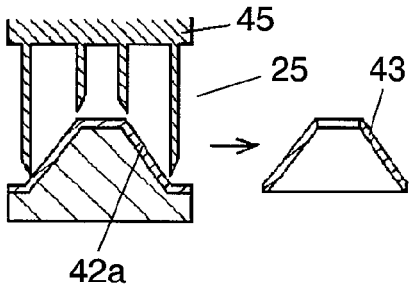
FIG. 1D is a conceptual diagram showing a part of the production equipment of the paper-made diaphragm for the loudspeaker, according to the first embodiment of the present invention.

Next, as shown in FIG. 1D, shape processing device 25 has stamping die 45. Dried material 42*a* with its moisture vaporized, of the paper-made diaphragm for the loudspeaker is stamped into an outermost periphery and a center hole through which a voice coil is inserted, by stamping die 45 using shape processing device 25. This action produces paper-made diaphragm 43 for the loudspeaker (shape processing step in S05).

By the above-described method, diaphragm 43 is produced using the production equipment of the present invention.

Here, the description is made for the production equipment of a press diaphragm including pressure device 24. However, heat-pressurizing diaphragm material 42 for the loudspeaker using pressure device 24 is not necessarily required. For example, dried diaphragm material 42*a* for the loudspeaker may be produced by drying diaphragm material 42 for the loudspeaker for about one day or two without using pressure device 24. Diaphragm 43 produced by drying without using pressure device 24 is referred to as an oven diaphragm, or non-press diaphragm.

As described above, a step of fining material 31 is repeated to obtain material 38 desirably fined, thereby yielding diaphragm 43 with high accuracy. This action enables fine-tuning of sound quality using diaphragm 43, thus implementing loudspeaker 80 satisfying both market and user needs.

The pressure applied on mixed liquid 30 by high-pressure pump 34 of fining device 22 is desirably 10 MPa or higher to promote fining material 31, thereby completing the fining step in a short time. Accordingly, even if plural times of fining steps are repeated, they are completed in a short time, thereby improving production efficiency.

Liquid 32 to be mixed with material 31 is typically water. However, liquid 32 containing alcohol is preferable, or liquid 32 of pure alcohol may be used. Liquid 32 containing alcohol suppresses rot of material 31. Alcohol has favorable volatility, and thus using liquid 32 of pure alcohol or containing some alcohol reduces the time for vaporizing the moisture contained in diaphragm material 42 for the loudspeaker. This improves the production efficiency of diaphragm 43.

As described above, the production equipment of the present invention includes at least mixing device 21, fining device 22, paper-making device 23, and shape processing device 25 for implementing the mixing step, the fining step, the paper-making step, and the shape processing step, respectively. Particularly, fining device 22 is used in the fining step. Accordingly, material 31 is not required to be beaten into fine pieces by repeating the same operation using a beating device spending several days. Thus, the fining step dispenses with rotating devices such as a beater, a refiner, or a mixer.

As described above, fining device 22, unlike a conventional beating device, applies pressure on material 31 to pass orifice 35 before making material 31 collide against inner wall 36 at high speed. After that, fining device 22 decelerates material 31 to give it a shearing force, thereby fining material 31 instantly. This action significantly reduces the time for producing diaphragm 43. This action provides the production equipment that significantly reduces the time for producing the paper-made diaphragm although the paper-making step is used, and that produces superior diaphragm 43.

As described above, the production equipment of the present invention provides with high productivity diaphragm 43 with favorable characteristics as the loudspeaker, high flexibility in adjusting sound quality, and high accuracy, thereby reducing the price of the loudspeaker.

Here, material 31 used for diaphragm 43 described above is typically kraft pulp made from softwood. This results in accelerating shortage of softwood, and thus a use of earth-conscious material is desired.

Meanwhile, bamboo, with high fertility and rapid growth, prevails throughout the world in extremely large numbers both in variety and quantity. Additionally, some specific areas suffer from harm caused by expanded bamboo groves.

Bamboo has stable physical properties in rigidity and toughness after one year or more elapses. Accordingly, a bamboo grove is immediately reproduced to its former state after the bamboo is cut down.

Under the circumstances, a bamboo shoot of one year or younger, or young-culmed bamboo, for easiness to split a bamboo fiber, are researched for application to the paper-made component for the loudspeaker, enjoying limited success. However, to cause the inherent advantage of the bamboo fiber to be exhibited, it is more effective to use the fiber of grown bamboo of one year or older having rigidity and toughness rather than a bamboo shoot of one year or younger, or young-culmed bamboo, which is soft and easy to process.

Meanwhile, using the production equipment of the present invention allows adequately fining the fiber of grown bamboo, thereby producing the paper-made component for the loudspeaker making full use of the inherent advantage of the bamboo fiber. Particularly, the fining step with fining device 22 used is effective to fine the fiber of grown bamboo, in which mixed liquid 30 is pressurized to pass through orifice 35, and collides against inner wall 36 to fine material 31, generating fined material 38. Using the bamboo fiber fined by fining device 22 for diaphragm 43 implements diaphragm 43 satisfying public demands in sound quality.

Bamboo, unlike softwood, does not grow with annual rings, but the fiber has a multilayered structure and directionality. Thus, when the production equipment of the present invention is used to fine material 31 containing the bamboo fiber and fined material 38 containing the bamboo fiber is generated, the bamboo fiber is significantly feathered. This causes entanglement among the bamboo fiber that is not generated by a conventional splitting device. Consequently, using material 31 containing the bamboo fiber in the production equipment of the present invention produces the paper-made component for the loudspeaker particularly exhibiting a high acoustic velocity characteristic.

FIG. 3 shows a sectional view of the paper-made diaphragm for the loudspeaker, according to the first exemplary embodiment of the present invention.

As shown in FIG. 3, diaphragm 43 is the paper-made diaphragm for the loudspeaker, produced with the above-described production equipment and by the production method.

For example, diaphragm 43 is obtained as the following. That is, material 31 containing the bamboo fiber is mixed with liquid 32 by mixing device 21. Next, fining device 22 is used to apply pressure on mixed liquid 30 containing the bamboo fiber obtained by mixing device 21, and material 31 collides against inner wall 36 when passing through orifice 35. Fined material 38 obtained by fining device 22 is paper-made by paper-making device 23. Diaphragm material 42 for the loudspeaker, which is the paper-made component produced by paper-making device 23, is shape-processed by shape processing device 25 to produce diaphragm 43.

As described above, diaphragm 43, although it is the paper-made diaphragm involving the paper-making step, has its reduced production time. This significantly increases flexibility in adjusting the characteristics as the loudspeaker and sound quality. Further, diaphragm 43 with high productivity and low cost is provided.

Additionally, diaphragm 43 contains fined material 38. This makes use of the feature of fined material 38 to implement diaphragm 43 with strong tangle of fiber, high rigidity, and toughness. Accordingly, diaphragm 43 extends its high threshold frequency and improves its reliability.

Furthermore, using the bamboo fiber as fined material 38 implements the diaphragm with further higher rigidity and toughness. Accordingly, diaphragm 43 with its extended high threshold frequency and further improved reliability is available. Meanwhile, using bamboo with its growth faster than softwood implements an earth-conscious diaphragm.

Diaphragm 43 shown in FIG. 3 is produced from bamboo fiber made of bamboo of one year or older. Diaphragm 43 desirably contains fined material 38 fined to the beating degree of the bamboo fiber of a microfibril state, and such fined material 38 is paper-made. Microfibrillating fined material 38 such as the bamboo fiber is preferably made so that the average fiber diameter is smaller than 5 μm, and the value of L/D (average fiber length/average fiber diameter) is 10 or more.

A smaller average fiber diameter of microfibrillated fined material 38 is more preferable. That is, a small average fiber diameter of fined material 38 makes the entanglement of fiber favorable.

A larger value of L/D (average fiber length/average fiber diameter) of fined material 38 microfibrillated is more preferable. That is, a large value of L/D of fined material 38 makes the entanglement of fiber favorable.

Further, the beating degree of fined material 38 microfibrillated is preferably 5 μm or shorter in average fiber diameter, where 1 μm or shorter is more preferable and 500 nm is still further preferable. This makes the entanglement of fiber be performed more effectively. Even if the average fiber diameter is larger than 5 μm, the bamboo fiber used for diaphragm 43 can exhibit its advantage. However, to enhance the entanglement of fiber, the smaller average fiber diameter tends to be favorable.

The bamboo fiber of grown bamboo of one year or older has high rigidity and toughness. The bamboo fiber is well-suited when mixed with a pulp and a paper, which facilitates improving the rigidity, toughness, and Young's modulus of diaphragm 43. That is, the bamboo fiber is microfibrillated and beaten into extremely small pieces for paper-making. Accordingly, the bamboo fiber microfibrillated is mixed with the pulp and the paper, the entanglement with the pulp and the paper is further made favorable, diaphragm 43 is given adequate rigidity and toughness, and the Young's modulus is raised.

Here, any bamboo fiber may be used as long as it is a bamboo-family plant. Grown bamboo of one year or older, excluding the bamboo shoot of one year or younger, or the young-culmed bamboo, is particularly preferable. Bamboo of one year or older ensures rigidity and toughness high enough to exhibit the advantage of the present invention. Two years or older further improves rigidity and toughness, and three or older still further.

As described above, older bamboo is more preferable except for a rotten old state.

Diaphragm 43 produced from the bamboo fiber improves the sound pressure level in high frequencies as an advantage in sound quality, thereby providing clear, powerful sound in high frequencies. In low frequencies, meanwhile, diaphragm 43 reproduces tight, well-defined deep bass. On the whole, quality-sound diaphragm 43 is implemented that is high in articulation, crisp, favorable in sound image localization.

Further, diaphragm 43 thus produced from the bamboo fiber improves toughness as compared to that produced from a pure pulp and the paper, superior in quality and reliability as well. Accordingly, the loudspeaker including diaphragm 43 produced from the microfibrillated bamboo fiber improves various reliability as represented by higher resistance to input and by reliability in moisture resistance. Various reliability such as that in moisture resistance is extremely important to an automobile loudspeaker. Consequently, the loudspeaker including diaphragm 43 produced from the microfibrillated bamboo fiber implements quality sound, high output, and high reliability.

In addition, diaphragm 43 produced from the bamboo fiber, according to the present invention is an inexpensive, earth-conscious paper-made diaphragm for the loudspeaker.

Hereinbefore, the description is made for diaphragm 43 out of the paper-made component for the loudspeaker. However, the paper-made component for the loudspeaker is not limited to paper-made diaphragm 43 for the loudspeaker, but the present invention is applicable to such as a sub-cone and a dust cap for the loudspeaker. The paper-made component for the loudspeaker may be sub-cone 72 (referred to as sub-cone 72 hereinafter) for the loudspeaker shown in FIG. 4 or dust cap 73 (referred to as cap 73 hereinafter) for the loudspeaker shown in FIG. 5. That is, applying the above-described production equipment to sub-cone 72 or cap 73 implements the same advantage as described above.

Figure 4:
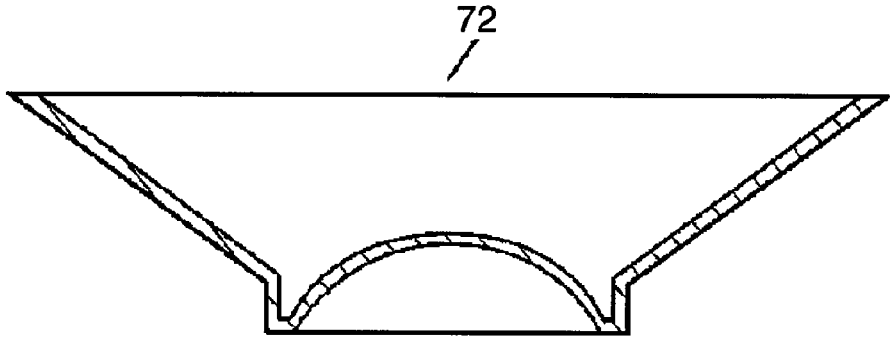
FIG. 4 is a sectional view of a sub-cone of a loudspeaker, according to the first embodiment of the present invention.
Figure 5:
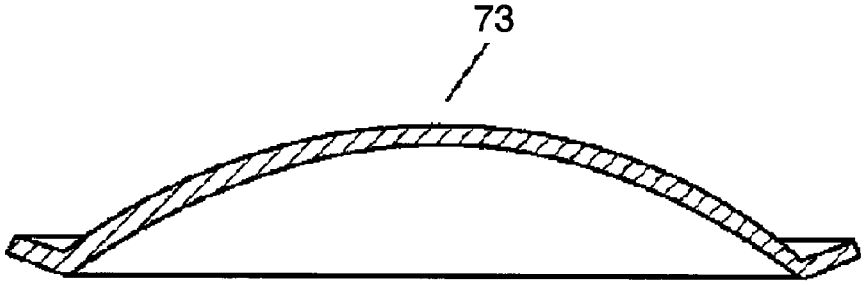
FIG. 5 is a sectional view of a dust cap for a loudspeaker, according to the first embodiment of the present invention.

For sub-cone 72 shown in FIG. 4 and cap 73 shown in FIG. 5, the embodiment related to the application of the above-described production equipment and method is the same as that related to diaphragm 43, and thus a detailed description is omitted.

Second Exemplary Embodiment

Hereinafter, a description is made for the second exemplary embodiment of the present invention, using the related drawings. A component same as that of the first embodiment is given the same mark to omit its detailed description.

Figure 6:
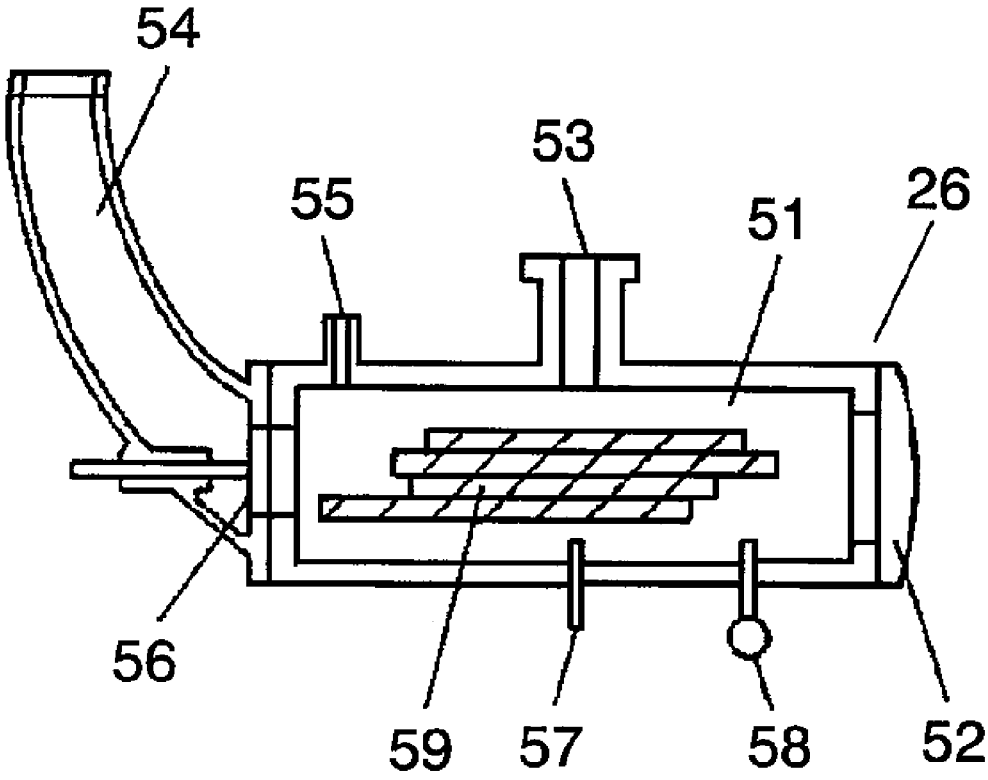
FIG. 6 is a conceptual diagram showing a part of a production equipment of a paper-made diaphragm for a loudspeaker, according to a second exemplary embodiment of the present invention.
Figure 7:
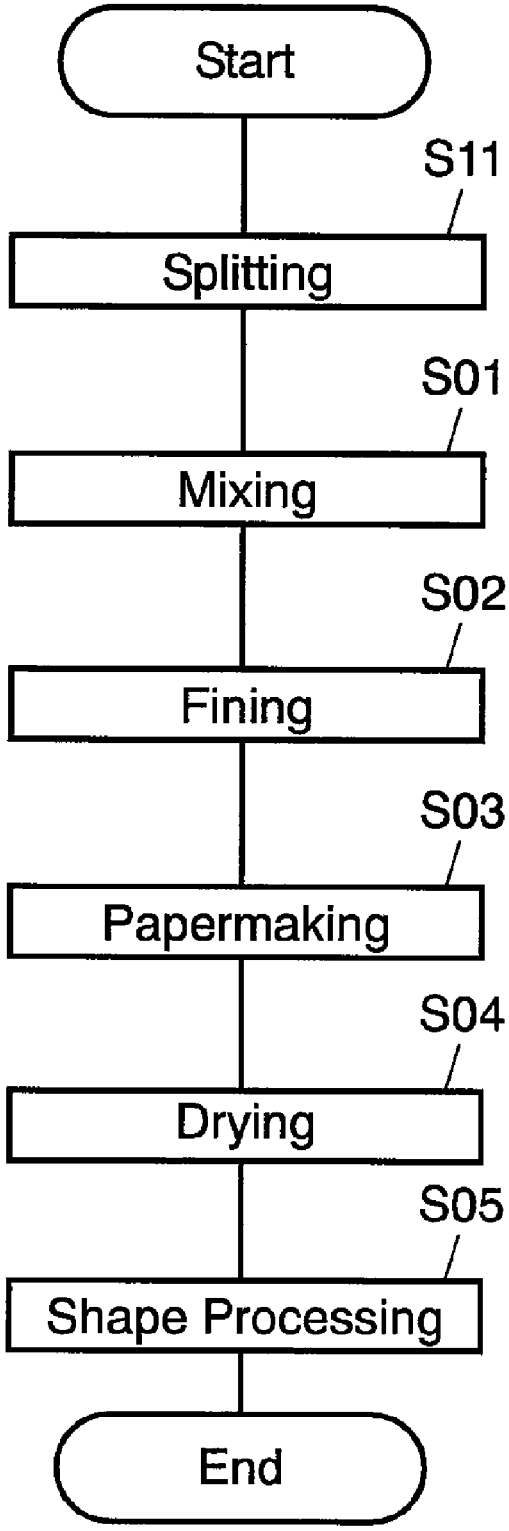
FIG. 7 is a flowchart illustrating a method of producing the paper-made diaphragm for the loudspeaker, according to the second embodiment of the present invention.

FIG. 6 is a conceptual diagram showing a part of a production equipment of a paper-made diaphragm for a loudspeaker, according to the second embodiment of the present invention. FIG. 7 is a flowchart illustrating a method of producing a paper-made diaphragm for the loudspeaker, using the production equipment according to the second embodiment of the present invention.

As shown in FIGS. 6, 7, the second embodiment is different from the first in that the second embodiment has a splitting step (S11) before mixing step (S01), where blasting device 26 is further provided that composes a splitting device implementing the splitting step.

Blasting device 26 is largely different from a beating device requiring several days for a series of processes from inserting material to a state ready for paper-making. That is, blasting device 26 uses a pressure chamber to instantly fine material 59. Blasting device 26 fines material 59 reliably and efficiently by a steam-blasting process. Steaming conditions of the steam-blasting process controls the composition of lignin, hemicellulose, and cellulose contained in material 59. This implements the production equipment of diaphragm 43 with further higher accuracy.

The blasting process using blasting device 26 applies pressure in a pressure chamber resistant to high pressure to apply high pressure on internal material 59. Next, the pressure chamber subjected to pressure is momentarily opened to allow it to be at normal pressures. This action causes the pressure raised inside material 59 to be rapidly expanded (adiabatic expansion), thereby splitting material 59 into fine pieces (S11). Here, when internal material 59 is steamed with high-temperature, high-pressure, saturated vapor for short time, the blasting process is referred to as the steam-blasting process. Material 59 split by the blasting process is subjected to heat decomposition and physical fibrosing of the fiber contained in material 59 to produce a blasted material with a fiber structure effective for paper-making. Further, material 59 split by the blasting process is fined by fining device 22 to promote microfibrillation, thereby implementing further high-performance diaphragm 43.

As shown in FIG. 6, blasting device 26 implementing the blasting process includes autoclave 51 as a pressure chamber, lid 52, pressure duct 53, discharge duct 54, safety valve 55, open valve 56, thermometer 57, and manometer 58.

In the blasting process, first, lid 52 of autoclave 51 as a container in which blasting process is performed is opened, material 59 of diaphragm 43 is inserted into autoclave 51, and then lid 52 is closed, where open valve 56 as well is in a closed state. Then, air containing vapor is supplied from a boiler (not shown) as a heating device through pressure duct 53 to raise the pressure inside autoclave 51 at a burst. This causes moisture to be rapidly introduced into the inside of material 59, so that material 59 is changed to a compressed state. The condition for reliably executing the steam-blasting process is that material is steamed with vapor of approximately 175° C. for 5 to 10 minutes, where splitting material 59 is extremely effective although it takes some time. The condition for the blasting process is not limited to the above, but is determined as appropriate in consideration of the characteristics of material 59, those after splitting, and others.

In another moment, open valve 56 is opened, the air containing vapor is discharged at a burst through discharge duct 54, and the pressure inside autoclave 51 falls at a burst. This blasts material 59 arranged inside autoclave 51 into fine pieces. That is, material 59 is split into a fibrous form. After that, lid 52 is opened and material 59 blasted is extracted. Material 59 blasted is used as material 31 in the next mixing step.

In the second embodiment, therefore, as shown in FIGS. 6 and 7, blasting device 26 added maintains high productivity. This controls the fining step with fining device 22 used more minutely, thereby further increasing the flexibility in adjusting the characteristics as the loudspeaker and sound quality.

In the blasting process, not only water but other liquid can be used as a medium for high-pressure vapor supplied from the boiler. Moreover, by using liquid as the medium having a function for alkalizing material 59, material 59 can be alkali-treated simultaneously with the blasting process.

Here, liquid used for alkali treatment may be a 0.6% to 20% sodium hydroxide solution, for example. Liquid used for alkali treatment is determined in consideration of the characteristics of such as a lignin component contained in material 59. Material 59 alkali-treated results in improved workability in such as the shape processing step.

When one splitting step does not attain a predetermined split state of material 59 or when plural splitting steps are desired, a splitting step may be repeated twice, three times, n times, or even tens of times if necessary. The time required for all the splitting steps is short because one splitting step completes in very short time.

The production equipment of the paper-made diaphragm for the loudspeaker, according to the second embodiment can adequately split fiber of grown bamboo, producing a diaphragm making full use of the inherent advantage of the bamboo fiber. Particularly, material 31 supplied to fining device 22 is preliminarily split in the splitting step using blasting device 26, and thus the second embodiment is further effective for splitting fiber of grown bamboo.

As described above, the present invention provides the production equipment of the superior paper-made diaphragm for the loudspeaker with reduced production time, which is usually long. This enables providing diaphragm 43 with extremely high flexibility in adjusting the characteristics as the loudspeaker and sound quality, with still further high productivity, thereby facilitating price reduction of the loudspeaker. Additionally, the production equipment of the paper-made diaphragm for the loudspeaker is applicable to the paper-made component for the loudspeaker such as sub-cone 72 and cap 73, other than paper-made diaphragm 43.

Third Exemplary Embodiment

Hereinafter, a description is made for the third exemplary embodiment of the present invention, using the related drawings. Here, a component same as that of the first and second embodiments is given the same mark to omit its detailed description.

Figure 8:
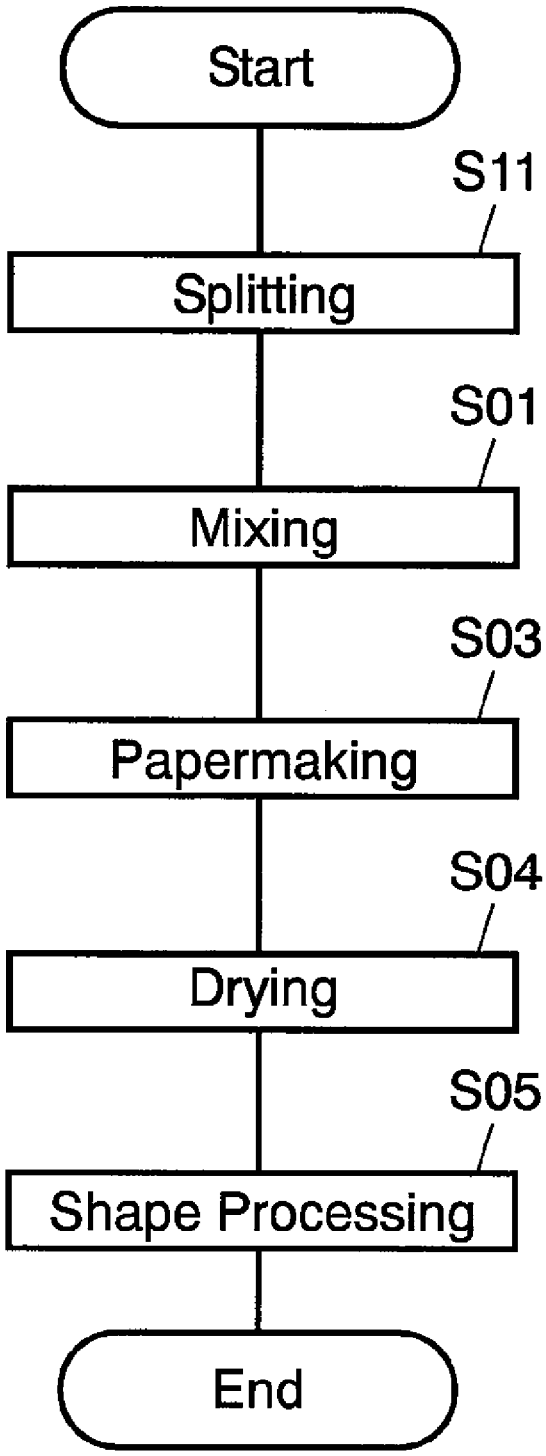
FIG. 8 is a flowchart illustrating a method of producing a paper-made diaphragm for a loudspeaker, according to a third exemplary embodiment of the present invention.

FIG. 8 is a flowchart illustrating a method of producing a paper-made diaphragm for a loudspeaker, using the production equipment according to the third embodiment of the present invention.

As shown in FIG. 8, the production equipment of the paper-made diaphragm for the loudspeaker, according to the third embodiment of the present invention includes devices implementing splitting step (S11), mixing step (S01), paper-making step (S03), drying step (S04), and shape processing step (S05), respectively. That is, the production equipment of the paper-made diaphragm for the loudspeaker includes blasting device 26 for implementing splitting step (S11), mixing device 21 for mixing step (S01), paper-making device 23 for paper-making step (S03), pressure device 24 for drying step (S04), and shape processing device 25 for shape processing step (S05), where pressure device 24 for drying step (S04) is not necessarily required.

As described above, the production equipment of the paper-made diaphragm for the loudspeaker, according to the third embodiment of the present invention does not include a conventional beating device. Thus, the equipment does not need to fine material 59 by repeating the same operation spending several days, unlike the conventional beating device, but increase and decrease in pressure split material 59 instantly, thereby reducing the production time of diaphragm 43 significantly.

As described above, the present invention provides the production equipment of the superior paper-made diaphragm for the loudspeaker with reduced production time, which is usually long. This enables providing diaphragm 43 with extremely high flexibility in adjusting the characteristics as the loudspeaker and sound quality, with high productivity, thereby reducing the price of the loudspeaker. Additionally, the production equipment of the paper-made diaphragm for the loudspeaker is applicable to the paper-made component for the loudspeaker such as sub-cone 72 and cap 73, other than paper-made diaphragm 43.

Fourth Exemplary Embodiment

Hereinafter, a description is made for the fourth exemplary embodiment of the present invention, using the related drawings. Here, a component same as that of the first through third embodiments is given the same mark to omit its detailed description.

Figure 9:
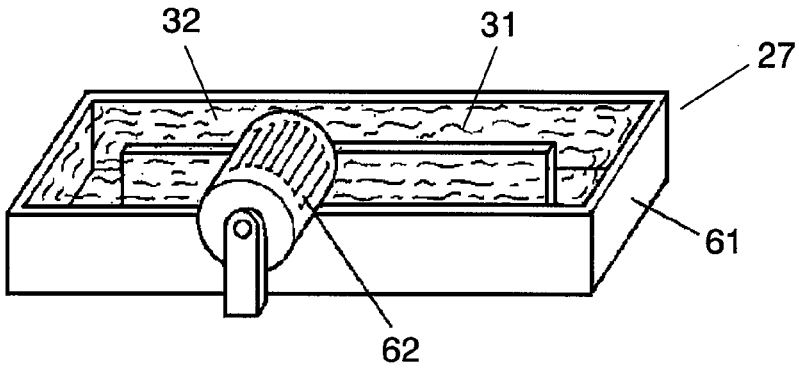
FIG. 9 is a conceptual diagram showing a part of a production equipment of a paper-made diaphragm for a loudspeaker, according to a fourth exemplary embodiment of the present invention.
Figure 10:
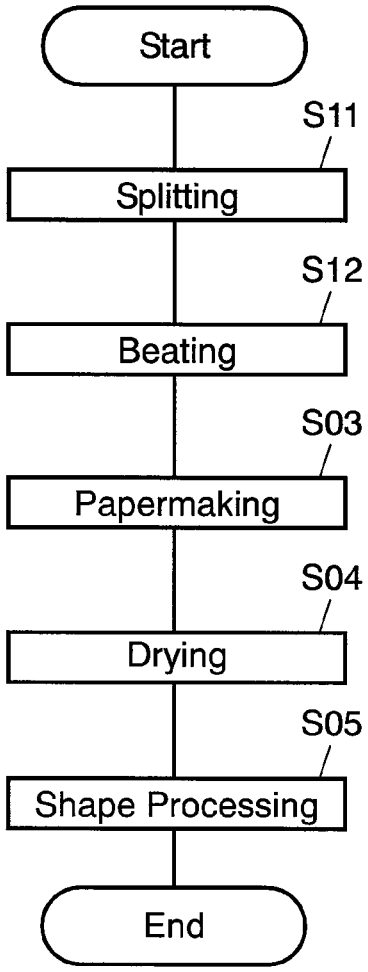
FIG. 10 is a flowchart illustrating a method of producing the paper-made diaphragm for the loudspeaker, according to the fourth exemplary embodiment of the present invention.

FIG. 9 is a conceptual diagram showing a part of a production equipment of a paper-made diaphragm for a loudspeaker, according to the fourth embodiment of the present invention. FIG. 10 is a flowchart illustrating a method of producing the paper-made diaphragm for the loudspeaker, using the production equipment according to the fourth embodiment of the present invention.

As shown in FIGS. 9 and 10, the production equipment of the paper-made diaphragm for the loudspeaker, according to the fourth embodiment of the present invention includes devices implementing splitting step (S11), beating step (S12), paper-making step (S03), drying step (S04), and shape processing step (S05), respectively. That is, the production equipment of the paper-made diaphragm for the loudspeaker includes blasting device 26 for implementing splitting step (S11), beating device 27 for beating step (S12), paper-making device 23 for paper-making step (S03), pressure device 24 for drying step (S04), and shape processing device 25 for shape processing step (S05), where pressure device 24 for drying step (S04) is not necessarily required.

As shown in FIG. 9, beating device 27 includes beater 61 and rotary blade 62. Material 31 split in the splitting step is inserted into beater 61 containing liquid 32 such as water, and rotary blade 62 rotates. This action beats material 31 into fine pieces using beating device 27. Here, material 31 inserted into beating device 27 is already in a state split in the splitting step. That is, beating device 27 according to the fourth embodiment executes a beating step for fine-tuning the fibrillation degree of material 31. Thus, the beating step executed with beating device 27 completes in several minutes to several hours (S12).

Beating device 27 further uniformizes and stabilizes the split state of material 31. This implements the paper-making with high accuracy, thereby producing diaphragm 43 with stable quality. Beating device 27 acts as mixing device 21 for mixing liquid 32 and material 31 as well. Thus, with beating device 27 included, special mixing device 21 is not necessarily required. That is, the beating step (S12) includes a mixing step, and thus a special mixing step is not required.

Figure 11:
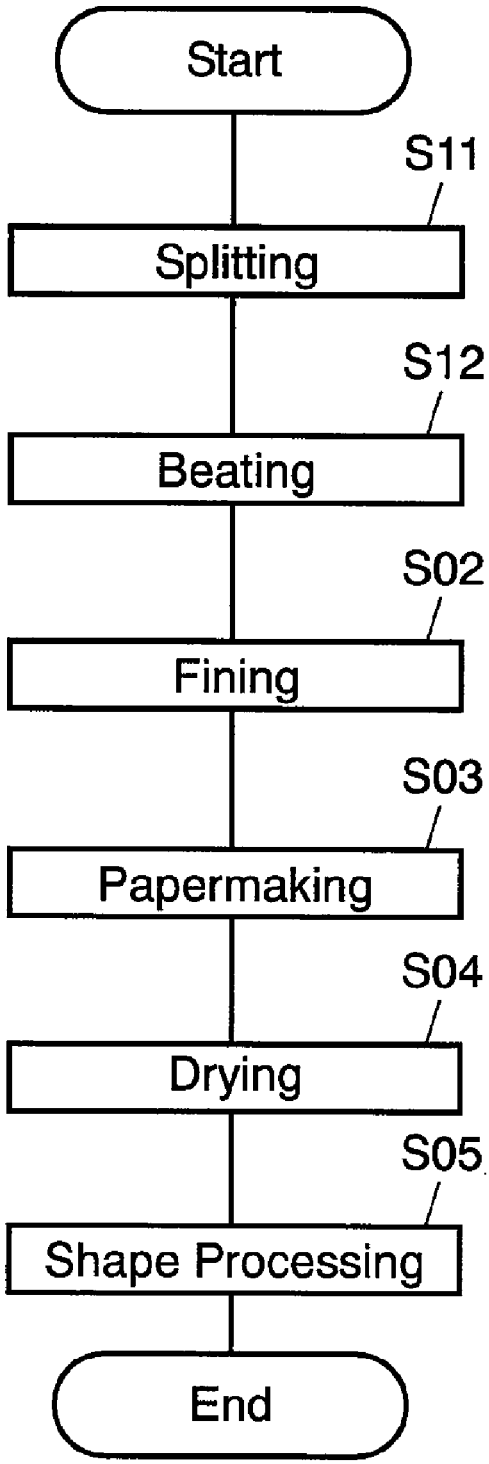
FIG. 11 is a flowchart illustrating another aspect of the method of producing the paper-made diaphragm for the loudspeaker, according to the fourth embodiment of the present invention.

Further, beating device 27 may use fining device 22 as a microfibrillating beating device. That is, as shown in FIG. 11, fining step (S02) may be added after beating step (S12). Further providing fining device 22 as the microfibrillating beating device still further improves the fibrillation degree of material 31 to produce fined material 38. This further improves entanglement of fined material 38 in the paper-making step. Consequently, superior diaphragm 43 with high rigidity and toughness is available.

As described above, beating device 27 beats material 31 using any member out of a beater, refiner, and mixer. The microfibrillating beating device may use fining device 22, or any member out of the beater, the refiner, and the mixer, like beating device 27.

In this way, material 31 whose fiber is split into small pieces by the splitting device such as blasting device 26 is first fine-tuned in its fibrillation degree by an existing beating device such as the beater, the refiner, or the mixer; or the microfibrillating beating device. This provides diaphragm 43 with high accuracy, and high rigidity and toughness, at low cost.

Fining device 22 used as the microfibrillating beating device can beat material 31 instantly by increase and decrease in pressure, in the same way as in the above-described description. Thus, fining device 22 as the microfibrillating beating device significantly reduces the beating time compared to such as the beater, the refiner, or the mixer.

As described above, diaphragm 43 represents reduced production time although it is the paper-made diaphragm with its fibrillation degree fine-tunable while further establishing superior production equipment of the paper-made diaphragm for the loudspeaker.

As described above, the production equipment of the paper-made diaphragm for the loudspeaker, according to the present invention provides diaphragm 43 with high flexibility in adjusting the characteristics as the loudspeaker and sound quality, with high accuracy and productivity. This implements the performance improvement and price reduction of the loudspeaker. In addition, the production equipment of the paper-made diaphragm for the loudspeaker is applicable to the paper-made component for the loudspeaker such as sub-cone 72 and cap 73, other than paper-made diaphragm 43.

Fifth Exemplary Embodiment

Hereinafter, a description is made for the fifth exemplary embodiment of the present invention, using the related drawings. Here, a component same as that of the first through fourth embodiments is given the same mark to omit its detailed description.

Figure 12:
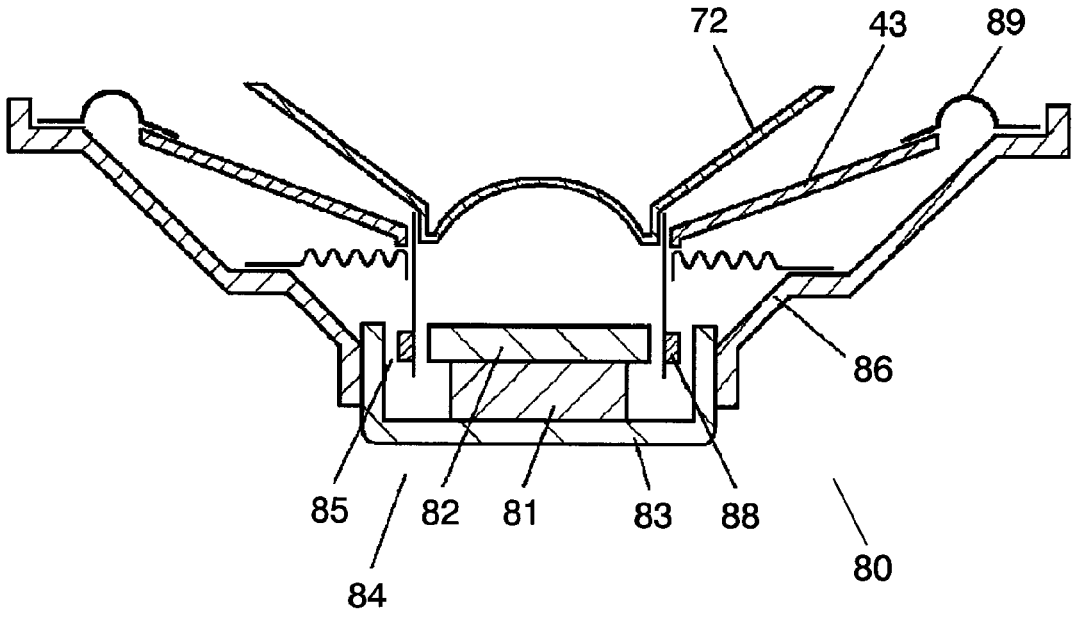
FIG. 12 is a sectional view of a loudspeaker according to the fifth exemplary embodiment of the present invention.
Figure 13:
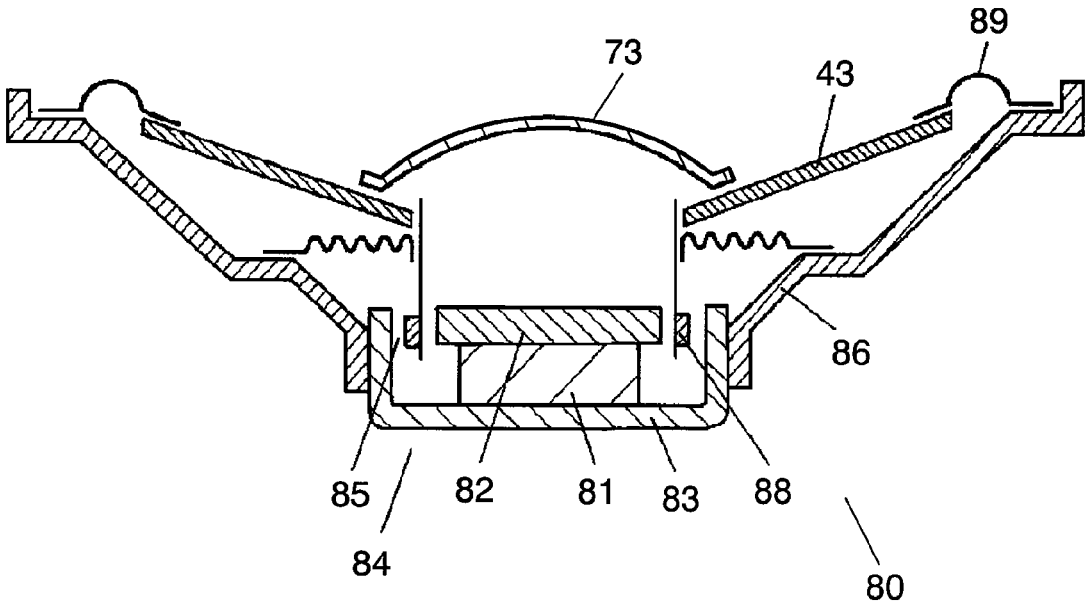
FIG. 13 is a sectional view of another aspect of the loudspeaker according to the fifth embodiment of the present invention.
Figure 14A:
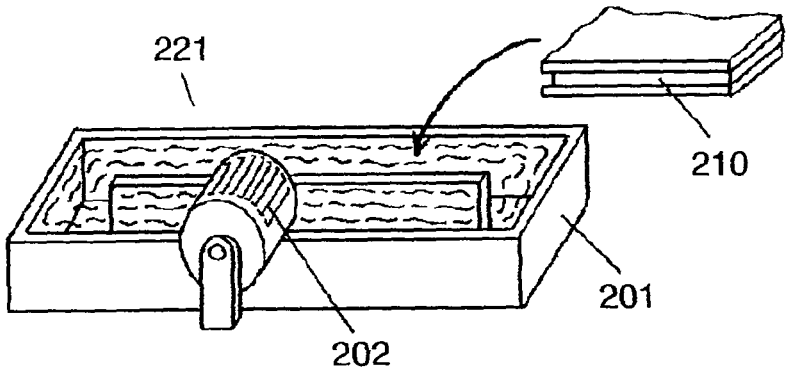
FIG. 14A PRIOR ART
FIG. 14A is a conceptual diagram showing a part of a conventional production equipment of a paper-made diaphragm for a loudspeaker.
Figure 14B:
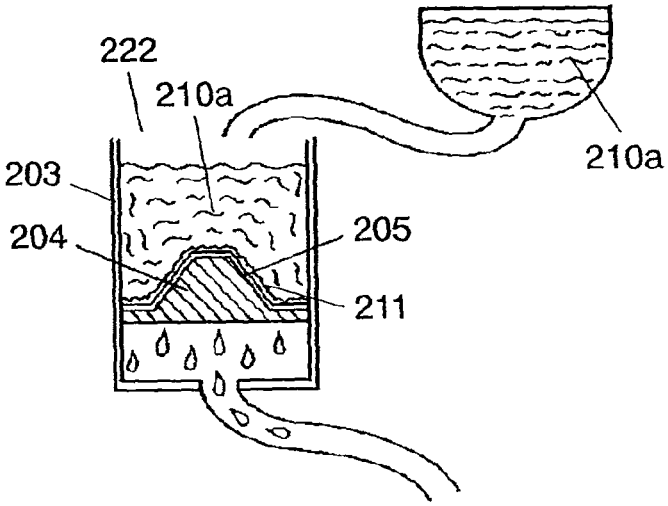
FIG. 14B PRIOR ART
FIG. 14B is a conceptual diagram showing a part of the conventional production equipment of the paper-made diaphragm for the loudspeaker.
Figure 14C:
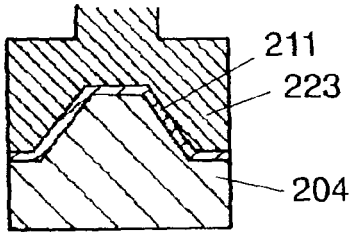
FIG. 14C PRIOR ART
FIG. 14C is a conceptual diagram showing a part of the conventional production equipment of the paper-made diaphragm for the loudspeaker.
Figure 14D:
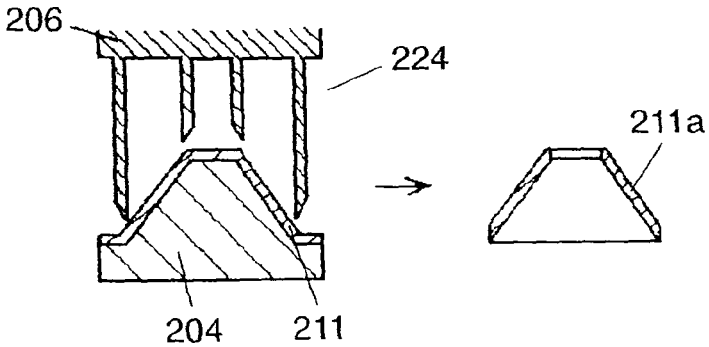
FIG. 14D PRIOR ART
FIG. 14D is a conceptual diagram showing a part of the conventional production equipment of the paper-made diaphragm for the loudspeaker.

FIG. 12 is a sectional view of a loudspeaker according to the fifth embodiment of the present invention. FIG. 13 is a sectional view of another aspect of the loudspeaker according to the fifth embodiment of the present invention.

As shown in FIG. 12, loudspeaker 80 includes magnetic circuit 84, diaphragm 43, and sub-cone 72. Magnetic circuit 84 of inner magnet type has magnetized magnet 81 inserted between upper plate 82 and yoke 83, where frame 86 is combined with yoke 83. A periphery of frame 86 has an outer periphery of diaphragm 43 bonded thereto through edge 89. One end of voice coil 88 is connected to a central portion of diaphragm 43. Meanwhile, the other end of voice coil 88 is inserted into magnetic gap 85 formed in magnetic circuit 84.

Then, sub-cone 72 is connected to a front surface of the central portion of diaphragm 43. FIG. 13 shows loudspeaker 80 including cap 73 instead of sub-cone 72. Meanwhile, diaphragm 43, sub-cone 72, and cap 73, which are paper-made components for the loudspeaker, are connected to voice coil 88 directly or indirectly and transmit the vibration of voice coil 88 to the air in the front surface of loudspeaker 80 to convert an electric signal input into loudspeaker 80 to sound.

Hereinafter, the description is made for loudspeaker 80 including magnetic circuit 84 of inner magnet type. However, magnetic circuit 84 is not limited to inner magnet type, but a loudspeaker (not shown) may include a magnetic circuit of external magnet type. Further, the loudspeaker may be a small loudspeaker (not shown) in which diaphragm 43 and edge 89 are integrated.

With such a structure, paper-made diaphragm 43 for the loudspeaker is used that is manufactured using the production equipment of the paper-made component for the loudspeaker described in the embodiments first through fourth. This implements superior loudspeaker 80 with favorable sound quality with a high degree of accuracy in adjusting the characteristics and tone quality, at low cost. Further, sub-cone 72 and cap 73 are composed of the paper-made component for the loud speaker, like diaphragm 43, manufactured by the production equipment described in the embodiments first through fourth. This provides superior loudspeaker 80 with its sound quality improved.

As an additional advantage, loudspeaker 80 is implemented with the rigidity and toughness of diaphragm 43 improved and superior in quality and reliability.

As described above, loudspeaker 80 is available with various reliability as represented by higher resistance to input and by reliability in moisture resistance improved. Loudspeaker 80 superior in performance, quality, and reliability is provided at low cost.

Here, loudspeaker 80 includes components manufactured by the production equipment of the paper-made component for the loudspeaker in the present invention as diaphragm 43, sub-cone 72, and cap 73. However, all the paper-made components for the loudspeaker are not necessarily those of the present invention, but part of the components to which the present invention is applied exhibit the effects and advantage of the present invention.

INDUSTRIAL APPLICABILITY

The production equipment of the present invention of the paper-made component for the loudspeaker reduces its production time and is applicable to that where high productivity and price reduction are compatible.

The invention claimed is:

1. Production equipment of a paper-made component for a loudspeaker, comprising:
   - a blasting device splitting fibrous material for the paper-made component by steam blasting thereby generating split material;
   - a beating device beating and mixing the split material into liquid to generate mixed liquid;
   - a fining device including a pressure unit, an orifice, and an inner wall,
     - wherein the pressure unit applies pressure on the mixed liquid, so that the mixed liquid passes through the orifice, and
     - the mixed liquid collides against the inner wall, thereby generating fined material;
   - a paper-making device paper-making the fined material and generating a paper-made component; and
   - a shape processing device processing a shape of the paper-made component.

2. The production equipment of the paper-made component for the loudspeaker of claim 1, wherein the fined material includes bamboo fiber.

3. The production equipment of the paper-made component for the loudspeaker of claim 1, wherein the generating of the fined material by the fining device is repeated.

4. The production equipment of the paper-made component for the loudspeaker of claim 1, wherein the pressure applied by the pressure unit on the mixed liquid is 10 MPa or higher.

5. The production equipment of the paper-made component for the loudspeaker of claim 1, wherein the liquid includes alcohol.

6. The production equipment of the paper-made component for the loudspeaker of claim 1, wherein the blasting device further includes alkali treatment.

7. The production equipment of the paper-made component for the loudspeaker of claim 1, wherein the beating device includes a microfibrillating beating device.

8. The production equipment of the paper-made component for the loudspeaker of claim 1, wherein the fining device is a high-pressure homogenizer.

* * * * *

UNITED STATES PATENT AND TRADEMARK OFFICE

CERTIFICATE OF CORRECTION

PATENT NO. : 8,343,313 B2
APPLICATION NO. : 12/162541
DATED : January 1, 2013
INVENTOR(S) : Kazuyoshi Mimura et al.

It is certified that error appears in the above-identified patent and that said Letters Patent is hereby corrected as shown below:

Title Page 2, Item (56) References Cited

At FOREIGN PATENT DOCUMENTS, please delete duplicate
"JP 63-126985 A 5/1988".

At FOREIGN PATENT DOCUMENTS, please delete
"JP 63-126985 A 11/1994".

Signed and Sealed this
Twenty-third Day of April, 2013

Teresa Stanek Rea
*Acting Director of the United States Patent and Trademark Office*